US005540258A

United States Patent [19]

Cho

[11] Patent Number: 5,540,258

[45] Date of Patent: Jul. 30, 1996

[54] HOLDING CHECK CONTROL VALVE

[75] Inventor: Hyung J. Cho, Changwon, Rep. of Korea

[73] Assignee: Samsung Heavy Industries Co., Ltd., Seoul, Rep. of Korea

[21] Appl. No.: 497,513

[22] Filed: Jun. 30, 1995

[30] Foreign Application Priority Data

Sep. 30, 1994 [KR] Rep. of Korea ..... 94-25346
Sep. 30, 1994 [KR] Rep. of Korea ..... 94-25348

[51] Int. Cl.[6] ..... F15B 13/04

[52] U.S. Cl. ..... 137/596.2; 251/282; 251/28; 251/44; 91/445

[58] Field of Search ..... 137/596, 489, 137/491; 251/28, 282, 44, 322; 91/446, 445, 447

[56] References Cited

U.S. PATENT DOCUMENTS

| | | | |
|---|---|---|---|
| 4,154,262 | 5/1979 | Blume et al. | 137/596.2 X |
| 4,172,582 | 10/1979 | Bobnar | 251/282 X |
| 4,220,178 | 9/1980 | Jackson | 251/282 X |
| 4,244,275 | 1/1981 | Smilges | 91/445 X |
| 4,688,600 | 8/1987 | Kreth et al. | 91/446 X |
| 5,022,434 | 6/1991 | Tsukimoto | 137/596.2 |

*Primary Examiner*—Hoang Nguyen
*Attorney, Agent, or Firm*—Kenyon & Kenyon

[57] ABSTRACT

A holding check control valve including a main valve, an assistant valve, a check valve installed in an actuator fluid passage provided at the main valve and provided with a spring chamber, the check valve being adapted to be switched between an opened state for opening the actuator fluid passage and a closed state for closing the actuator fluid passage in response to a pressure difference between the actuator fluid passage and the spring chamber so that the return oil in the actuator fluid passage is returned via a return fluid line provided at the main valve at the opened state, a pair of spaced seat members fixedly disposed in the assistant valve, a hydraulic chamber defined between the seat members, the hydraulic chamber communicating with the spring chamber of the check valve, a plunger extending through the seat members, the plunger being slidable along the seat members between a position closing the hydraulic chamber and a position opening the hydraulic chamber, a pressure setting spring for exerting its resilience on one end of the plunger and thereby always urging the plunger toward the closing position thereof, and a piston for pushing the other end of the plunger and thereby moving the plunger to the opening position thereof against the resilience of the pressure setting spring so that oil in the spring chamber is discharged via the opened hydraulic chamber.

10 Claims, 3 Drawing Sheets

HOLDING CHECK CONTROL VALVE

BACKGROUND OF THE INVENTION

1. Field of the Invention

The present invention relates to a holding check control valve used in hydraulic devices for heavy construction equipment.

2. Description of the Prior Art

Holding check control valves are used to restrain or slowly feed a flow of return fluid from an actuator to a tank for a certain time. Where such holding check control valves are used in heavy construction equipment such as excavators or cranes, they perform functions enabling the boom or the arm to hold a very heavy weight or to move downward without any impact while supporting the weight.

A conventional holding check control valve is illustrated in FIGS. 1A and 1B. The holding check control valve includes a main valve part and an assistant valve part which are shown in FIGS. 1A and 1B, respectively. As shown in FIG. 1A, the main valve part of holding check control valve includes a check valve 102 disposed in an actuator fluid passage 101. the check valve 102 has a spring chamber A in which a spring 106 is disposed. The spring 106 serves to always urge the check valve 102 toward its closed position. At an opened position of the check valve 102, a flow of return oil in the check valve 102 is allowed to return to a tank T via a return fluid passage 105. In order to pass the return oil in the actuator fluid passage 101 there through, the check valve 102 should move upward, when viewed in FIG. 1A, so that it is opened. When the fluid pressure in the spring chamber A of the check valve is reduced below the fluid pressure in the actuator fluid passage 101, the fluid pressure exerted on inclined surfaces 102a and 102b of the check valve 102 in the actuator fluidpassage 101 forces the check valve 102 to move upward against the resilience of the spring 106, thereby causing the check valve 102 to be opened. For reducing the fluid pressure in the spring chamber A, the fluid in the spring chamber A should be discharged. To this end, the assistant valve part of the holding check control valve is constructed to restrain the discharge of the fluid in the spring chamber A (thereby closing the check valve 102) or slowly discharge the fluid (thereby gradually opening the check valve 102). As shown in FIG. 1B, the assistant valve part of the holding check control valve includes a seat member 202 fitted in the interior of a body 201 of the holding check control valve. The seat member 202 has a hollow portion 203 in which a plunger 204 is disposed such that it can slide left or right. The plunger 204 is resiliently supported at one end thereof by a pressure setting spring 205 such that it is always urged in a left direction. The other end of the plunger 204 faces a piston 206 which is adapted to move in a right direction by a pilot pressure Pi. As the piston 206 moves in the right direction by the pilot pressure Pi, the plunger 204 is moved in the same direction, thereby causing the spring chamber B to communicate with the hollow portion 203 of seat member. 202. As a result, the spring chamber B communicates with a return fluid passage 207 connected to the tank T so that the fluid from the spring chamber B can return to the tank T via the hollow portion 203 and return fluid passage 207. Meanwhile, the spring chamber A of the main valve part and the spring chamber B of the assistant valve part communicate with each other via a communicating fluid passage 208. The return fluid passage 105 of the main valve part communicates with the return fluid passage 207 of the assistant valve part via another connecting fluid passage.

However, the conventional holding check control valve having the above-mentioned construction requires a considerably high pilot pressure for moving the piston 206 to move the plunger 204 against the high fluid pressure of the spring chamber A upon opening a fluid line associated therewith because the high fluid pressure of the spring chamber A is directly exerted on the spring chamber B. This results in the requirement of an additional high pilot pressure source. Since the return fluid passage 207 of the assistant valve part communicates with the tank via the return fluid passage 105 of the main valve part, the plunger 204 maybe unintentionally moved to open the associated fluid line when the fluid pressure in the spring chamber A, namely, the fluid pressure in the spring chamber B is lower than the fluid pressure in the tank T during an operation of the associated actuator, even if no pilot pressure is generated. In order to avoid such an undesirable phenomenon, the conventional holding check control valve requires an additional check valve installed in the return fluid Passage. Moreover, the conventional holding check control valve involves careful and precise machining work for obtaining accurate centering and straightness of the seat member and plunger and a high manufacturing cost.

SUMMARY OF THE INVENTION

Therefore, an object of the invention is to provide a holding check control valve capable of moving its plunger by use of a relatively small pilot pressure to return oil, thereby eliminating the use of any additional high pilot pressure sources.

Another object of the invention is to provide a holding check control valve capable of ensuring accurate and stable workability and also to achieve an easier manufacturing process and a reduction in the manufacturing cost.

In accordance with the present invention, these objects can be accomplished by providing a holding check control valve comprising a main valve and an assistant valve for controlling a flow of return fluid from the main valve, further comprising: a check valve installed in an actuator fluid passage provided at the main valve and provided with a spring chamber, the check valve being adapted to be switched between the opened state for opening the actuator fluid passage and the closed state for closing the actuator fluid passage in response to a pressure difference between the actuator fluid passage and the spring chamber so that return oil in the actuator fluid passage is returned via a return fluid line provided at the main valve at the opened state; a pair of spaced seat members fixedly disposed in the assistant valve; a hydraulic chamber defined between the seat members, the hydraulic chamber communicating with the spring chamber of the cheek valve; a plunger extending through the seat members, the plunger being slidable along the seat members between a position closing the hydraulic chamber and a position opening the hydraulic chamber; a pressure setting spring for exerting its resilience on one end of the plunger and thereby always urging the plunger toward the closing position thereof; and means for exerting a predetermined pressure on the other end of the plunger thereby moving the plunger to the opening position thereof against the resilience of the pressure setting spring so that oil in the spring chamber is discharged via the opened hydraulic chamber.

BRIEF DESCRIPTION OF THE DRAWINGS

Other objects and aspects of the invention will become apparent from the following description of embodiments with reference to the accompanying drawings in which:

FIGS. 1A and 1B are sectional views respectively illustrating essential parts of a conventional holding check control valve, wherein FIG. 1A shows the main valve part whereas FIG. 1B shows the assistant valve part;

FIGS. 2A and 2B are sectional views respectively illustrating essential parts of a holding check control valve in accordance with an embodiment of the present invention, wherein FIG. 2A shows the main valve part whereas FIG. 2B shows the assistant valve part;

DETAILED DESCRIPTION OF THE PREFERRED EMBODIMENTS

Figure 1A:
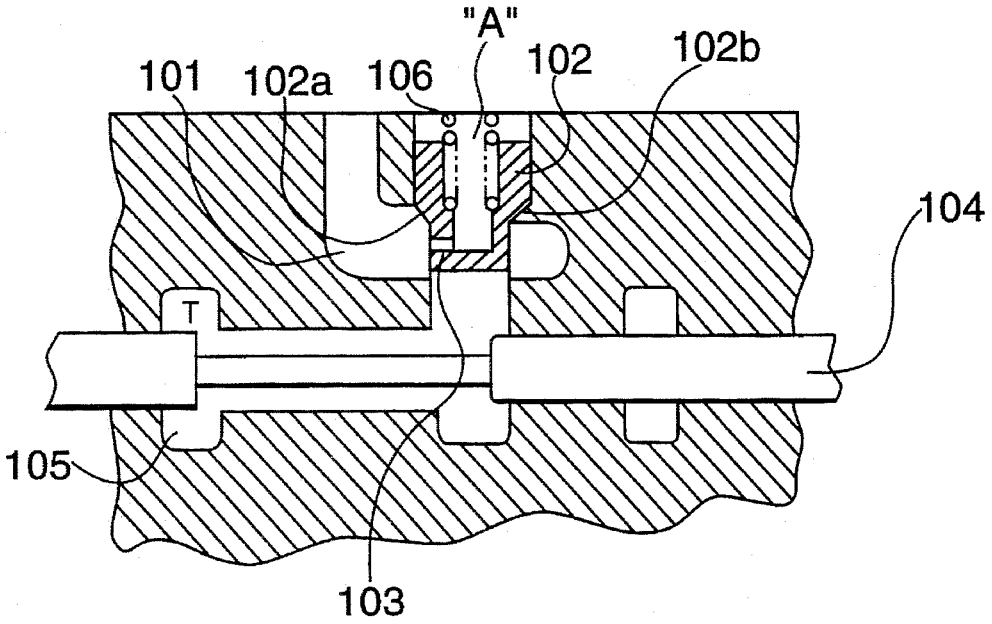
FIG. 1A PRIOR ART
Figure 2A:
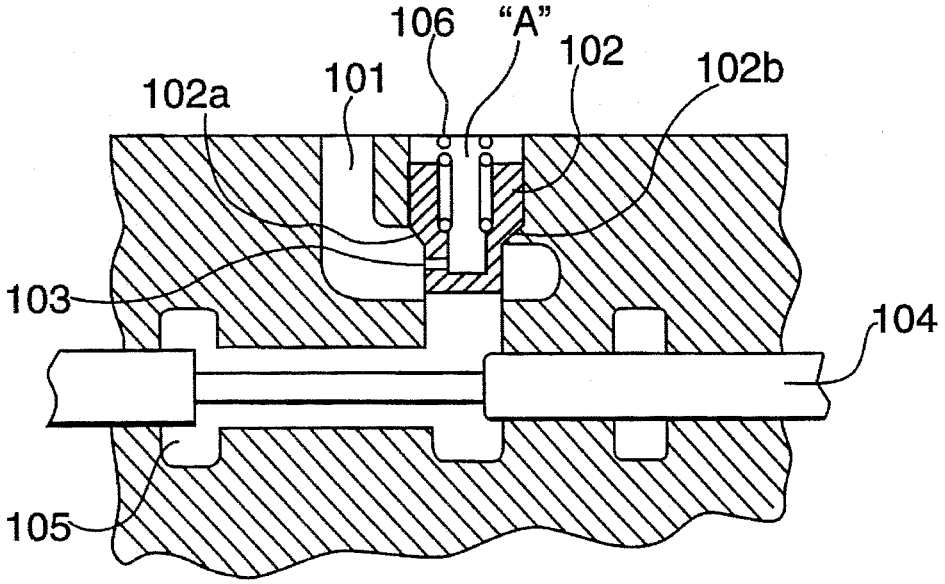
Figure 2B:
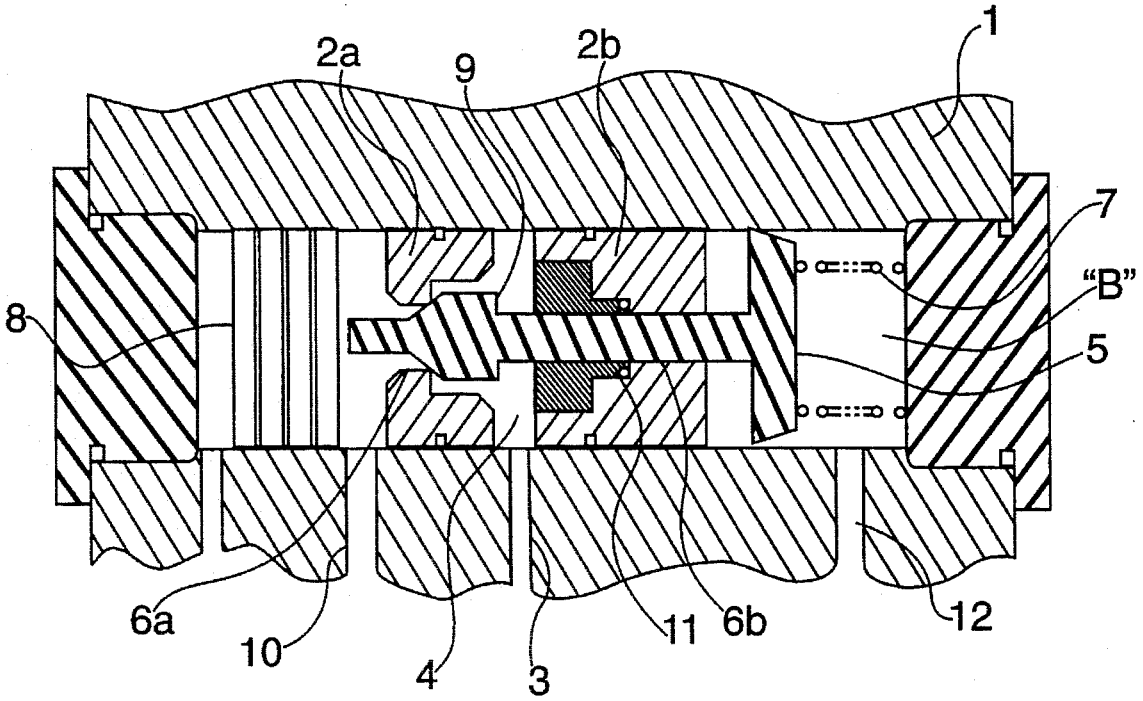

FIGS. 2A and 2B illustrate a holding check control valve in accordance with an embodiment of the present invention. FIG. 2A shows the main valve part of the holding check control valve whereas FIG. 2B shows the assistant valve part thereof. Since the main valve part shown in FIG. 2A has the same construction as the conventional one shown in FIG. 1A, its description will be omitted. In FIG. 2A, the reference numerals respectively corresponding to those in FIG. 1A are denoted by the same reference numerals.

Figure 1B:
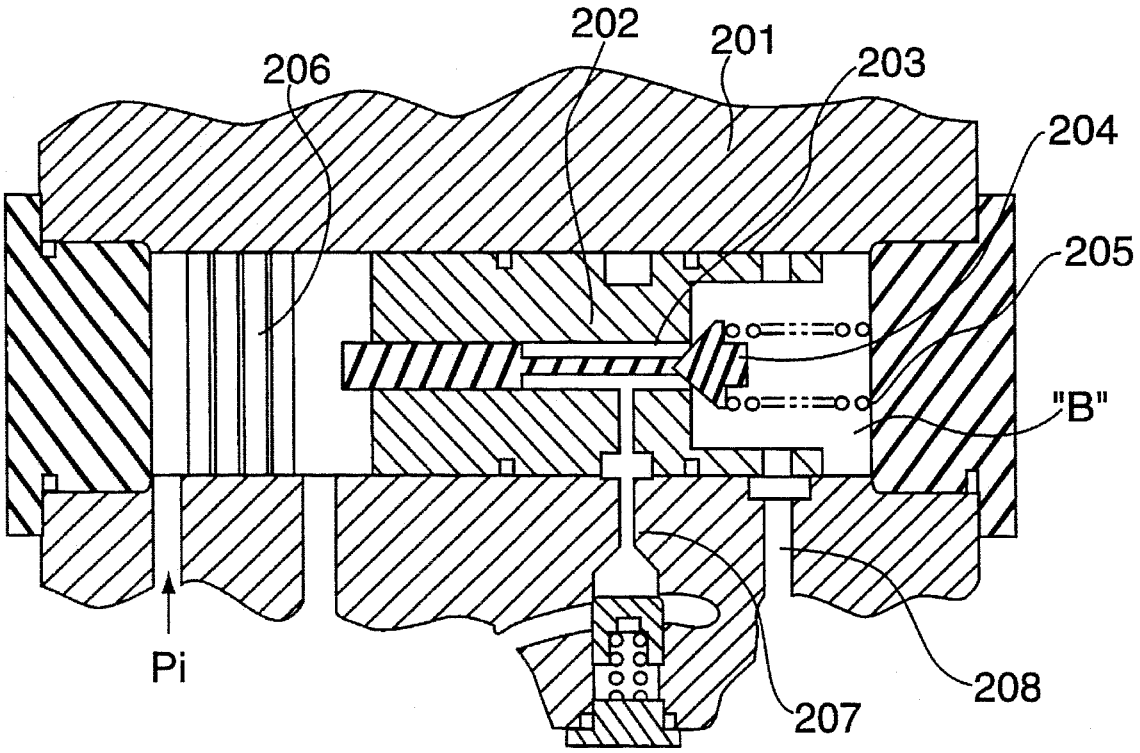
FIG. 1B PRIOR ART

The assistant valve part of the holding check control valve in accordance with the illustrated embodiment has a construction distinguished from the conventional one shown in FIG. 1B. As shown in FIG. 1B, the assistant valve part includes a pair of spaced seat members 2*a* and 2*b* fitted in a body 1 of the holding check control valve. Between the seat members 2*a* and 2*b*, a hydraulic chamber 4 is defined which communicates with the spring chamber A of the main valve part via a communicating fluid passage 3. The seat members 2*a* and 2*b* have hollow portions 6*a* and 6*b*. respectively. A plunger 5 extends through the seat members 2*a* and 2*b* such that it can slide left or right when viewed in FIG. 2B. A spring chamber B is provided in the valve body 1 at the side of the second seat member 2*b* opposite to the side facing the first seat member 2*a*. In the valve body 1, a piston 8 is also disposed at the side of the first seat member 2*a* opposite to the side facing to the second seat member. The plunger 5 has one end protruded outward beyond the second seat member 2*b* and resiliently supported by a pressure setting spring 7 disposed in the spring chamber B. The plunger 5 also has the other end protruded outward beyond the first seat member 2*a*. As the piston 8 is moved toward the plunger 5 by a pilot pressure Pi, it comes into contact with the other end of plunger 5, thereby causing the plunger 5 to slide against the resilience of the pressure setting spring 7. At the portion disposed in the hydraulic chamber 4, the plunger 5 has a pressure receiving portion 9 radially protruded as compared to other portions thereof. The pressure receiving portion 9 has an inclined end surface at one side thereof and an upright end surface at the other side thereof. The pressure receiving portion 9 of plunger 5 opens or closes the inlet of the hollow portion 6*a* of first seat member 2*a* at one side thereof as the plunger 5 slides right or left. In other words, when the plunger 5 moves right as the pilot pressure Pi is generated, the inclined end surface of the pressure receiving portion 9 is spaced from the inlet of the hollow portion 6*a* of first seat member 2*a*, thereby causing the hollow portion 6*a* to be opened. At this state, fluid in the hydraulic chamber 4 is returned to a tank (not shown) through a discharge fluid passage 10 provided at the valve body 1. The discharge fluid passage 10 communicates with the return fluid line 105 associated with the main valve part via another fluid line not shown, as in the conventional case.

Figure 3:
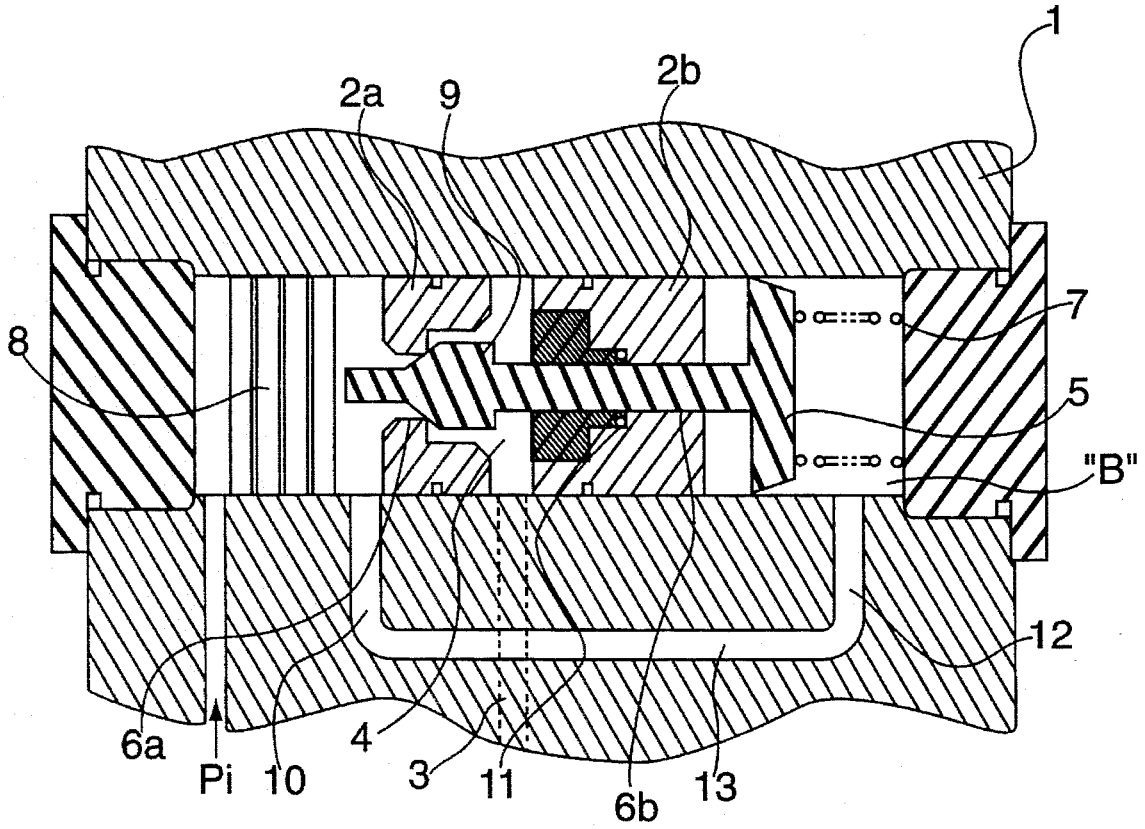
FIG. 3 is a sectional view illustrating the assistant valve part of a holding check control valve in accordance with another embodiment of the present invention.

Preferably, the discharge fluid passage 10 also communicates, via a communicating fluid passage 13, with another discharge fluid passage 12 which is provided at the valve body 1 to communicate with the spring chamber B receiving the pressure setting spring 7 for resiliently biasing one end of the plunger 5, as shown in FIG. 3. The fluid passage 13 communicates with the return fluid line 105 associated with the main valve part via another fluid passage not shown.

Figure 4:
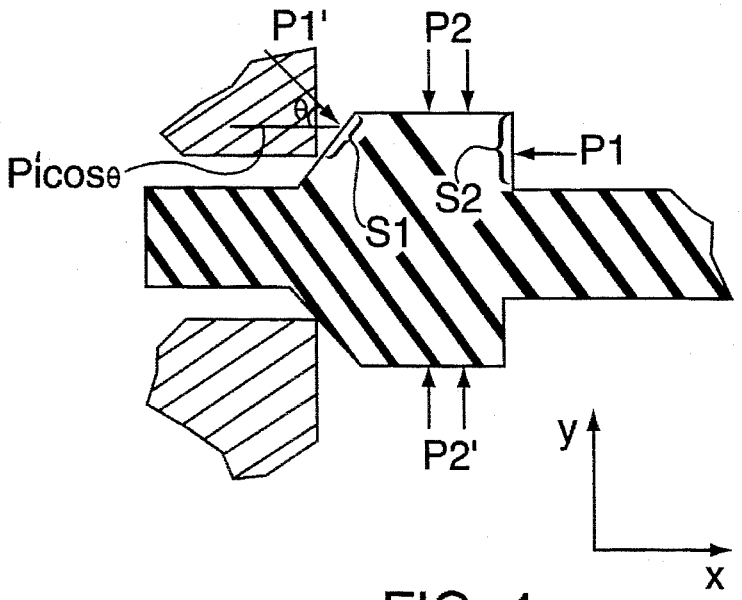
FIG. 4 is a schematic view explaining the relation between the construction of a plunger and the fluid pressure in a hydraulic chamber in the holding check control valve of FIG. 2.

It is also preferred that the pressure receiving portion 9 of plunger 5 disposed in the hydraulic chamber 4 to receive the fluid pressure of hydraulic chamber 4 has a construction capable of offsetting X- and Y-directional components of the fluid pressure applied to the pressure receiving portion 9 to each other, thereby causing the resultant pressure applied to the pressure receiving portion 9 to be zero, as shown in FIG. 4. That is, the pressure receiving portion 9 is designed in a fashion that opposite X-directional components P1 and P1'cos θ of the fluid pressure exerted in the hydraulic chamber 4 are offset to each other and that opposite Y-directional components P2 and P2' of the fluid pressure are offset to each other. Such a construction of the pressure receiving portion 9 is obtained by satisfying not only the symmetry in Y-axis direction, but also the equation of S2=S1 cos θ where S1 represents the surface area, exposed to the hydraulic chamber 4, of the inclined end surface provided at one side of the pressure receiving portion 9 in contact with the inlet of the hollow portion 6*a* of first seat member 2*a* is the same as cos θ and S2 represents the surface area of the upright end surface provided at the other side of the pressure receiving portion 9.

Preferably, a sealing member 11 Is fitted in the hollow portion 6*b* of second seat member 2*b* in order to provide a seal effect between the inner surface of hollow portion 6*b* and the outer surface of plunger 5. In place of the single sealing member, a plurality of sealing members may be used. The sealing member 11 serves to prevent the highly pressurized fluid in the hydraulic chamber 4 from leaking through the gap between the Inner surface of hollow portion 6*b* and the outer surface of plunger 5.

Operation of the holding check control valve having the above-mentioned construction will now be described.

When the piston 8 moves to the right, when viewed in FIG. 2B, as the pilot pressure Pi is supplied, the plunger 5 slides in the same direction, thereby opening the hollow portion 6*a* of first seat member 2*a* which has been maintained at its closed state by the pressure receiving portion 9 of plunger 5. At the opened state of the hollow portion 6*a*, oil in the spring chamber A of the main valve part is introduced in the hydraulic chamber 4 via the communicating fluid passage 3 and then returned to the tank via the opened hollow portion 6*a* and the discharge fluid passage 10. At this time, the fluid return speed and amount can be adjusted by controlling the pilot pressure Pi. Meanwhile, when the pilot pressure Pi is cut off, the plunger 5 is moved to the left by the resilience of pressure setting spring 7, thereby closing the hollow portion 6*a* of first seat member 2*a*. As a result, no oil can be discharged out of the hydraulic chamber 4. In other words, the oil in the spring chamber A can be discharged. In the main valve part, consequently, the fluid pressure in the spring chamber A is the same as the actuator fluid passage 101. As a result, the check valve 102 is forced to move downward, thereby closing the actuator fluid passage 101. Since the return fluid in the actuator fluid passage 101 can not flow, therefore, the actuator is held at the current state.

Since the pressure of the fluid from the spring chamber A introduced in the hydraulic chamber 4 through the communicating fluid passage 3 is exerted on the plunger 5 under a completely balanced condition in X- and Y-axis directions, it has no effect on the lateral movement of plunger 5 even if it is very high. Therefore, the pilot pressure Pi to be supplied for the movement of plunger 5 may be sufficiently small because it does not need to counteract to the fluid pressure in the hydraulic chamber 4. In other words, it is only required that the pilot pressure Pi overcomes the resilience of pressure setting spring 7 resiliently biasing the plunger 5. Accordingly, the holding check control valve of the illustrated embodiment does not need any separate high pilot pressure supply source for the movement of the plunger.

On the other hand, pressures respectively exerted on opposite ends of the plunger 5 are usually the same because the discharge fluid passage 10 and the discharge fluid passage 12 communicating with the spring chamber B communicate with the return fluid line 105 of the main valve part while communicating with each other via the fluid passage 13. Even though the fluid pressure in the tank varies, the plunger 5 is not affected by the pressure variation occurring in the tank because opposite ends of the plunger 5 receive equally the varied pressure.

Since the holding check control valve includes two separate seat members in accordance with the present invention, the work for seating the plunger can be carried out inside. This eliminates the necessity of using the work for centering the plunger with the seat members and the work for providing the straightness of these elements. It, therefore, is possible to greatly improve the workability of the elements of the holding check control valve and to reduce the manufacturing cost thereof. Furthermore, a more accurate and stable operation of the holding check control valve is ensured because the sealing member prevents any leakage of the highly pressurized fluid in the hydraulic chamber 4.

As apparent from the above description, the present invention provides a holding check control valve capable of moving its plunger by use of a relatively small pilot pressure to return oil, thereby eliminating the use of any additional high pilot pressure sources, achieving an easier manufacturing process and a reduction in the manufacturing cost and ensuring accurate and stable workability.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A holding check control valve comprising a main valve and an assistant valve for controlling a flow of return fluid from the main valve, further comprising:

a check valve installed in an actuator fluid passage provided at the main valve and provided with a spring chamber, the check valve being adapted to be switched between an opened state for opening the actuator fluid passage and a closed state for closing the actuator fluid passage in response to a pressure difference between the actuator fluid passage and the spring chamber so that the return oil in the actuator fluid passage is returned via a return fluid line provided at the main valve at the opened state;

a pair of spaced seat members fixedly disposed in the assistant valve;

a hydraulic chamber defined between the seat members, the hydraulic chamber communicating with the spring chamber of the check valve;

a plunger extending through the seat members, the plunger being slidable along the seat members between a position closing the hydraulic chamber and a position opening the hydraulic chamber;

a pressure setting spring for exerting its resilience on one end of the plunger and thereby always urging the plunger toward the closing position thereof; and means for exerting a predetermined pressure on the other end of the plunger and thereby moving the plunger to the opening position thereof against the resilience of the pressure setting spring so that oil in the spring chamber is discharged via the opened hydraulic chamber.

2. A holding check control valve in accordance with claim 1, further comprising a communicating fluid passage for making the hydraulic chamber communicate with a spring chamber receiving the pressure setting spring.

3. A holding check control valve in accordance with claim 2, wherein the communicating fluid passage communicates with the return fluid line of the main valve.

4. A holding check control valve in accordance with claim 1, wherein the means comprises a piston adapted to be moved by a predetermined pilot pressure applied thereto so that it pushes the other end of the plunger, thereby moving the plunger to the opening position thereof.

5. A holding check control valve in accordance with claim 2, wherein the means comprises a piston adapted to be moved by a predetermined pilot pressure applied thereto so that it pushes the other end of the plunger, thereby moving the plunger to the opening position thereof.

6. A holding check control valve in accordance with claim 3, wherein the means comprises a piston adapted to be moved by a predetermined pilot pressure applied thereto so that it pushes the other end of the plunger, thereby moving the plunger to the opening position thereof.

7. A holding check control valve in accordance with claim 1, wherein the plunger has at a portion thereof disposed in the hydraulic chamber a construction for offsetting X- and Y-directional components of a fluid pressure exerted on the plunger in the hydraulic chamber and thereby preventing the movement of the plunger from being affected by a fluid pressure exerted in the spring chamber.

8. A holding check control valve in accordance with claim 2, wherein the plunger has at a portion thereof disposed in the hydraulic chamber a construction for offsetting X- and Y-directional components of a fluid pressure exerted on the plunger in the hydraulic chamber and thereby preventing the movement of the plunger from being affected by a fluid pressure exerted in the spring chamber of the check valve.

9. A holding check control valve in accordance with claim 1, further comprising a sealing member interposed between one of the seat members disposed at the side of one end of the plunger and a portion of the plunger being in contact with the seat member.

10. A holding check control valve in accordance with claim 1, further comprising a sealing member interposed between one of the seat members disposed at the side of one end of the plunger and a portion of the plunger being in contact with the seat member.

* * * * *